United States Patent [19]

Glasser

[11] Patent Number: 4,459,135

[45] Date of Patent: Jul. 10, 1984

[54] THERMO-MECHANICAL APPARATUS AND METHOD

[76] Inventor: Alan Glasser, 32 Bala Ave., Bala Cynwyd, Pa. 19004

[21] Appl. No.: 419,867

[22] Filed: Sep. 20, 1982

[51] Int. Cl.[3] ..... C10J 3/00; C10J 3/72

[52] U.S. Cl. ..... 48/92; 48/111; 48/209; 110/229; 201/11; 201/25; 202/219; 422/132; 422/206; 422/235

[58] Field of Search ..... 48/92, 111, 209, 197 R; 110/229, 243, 250; 422/132, 206, 235; 201/11, 25; 202/219

[56] References Cited

U.S. PATENT DOCUMENTS

| | | | |
|---|---|---|---|
| 2,700,018 | 1/1955 | Gilbert | 201/11 |
| 3,192,018 | 6/1965 | Minami | 422/206 |
| 3,480,689 | 11/1969 | Bohrer | 48/92 |
| 3,738,815 | 6/1973 | Pawloski et al. | 422/132 |
| 3,812,620 | 5/1974 | Titus et al. | 48/209 |
| 3,890,908 | 6/1975 | Von Klenck et al. | 110/243 |
| 4,141,694 | 2/1979 | Camacho | 48/92 |

*Primary Examiner*—S. Leon Bashore, Jr.
*Assistant Examiner*—K. M. Hastings
*Attorney, Agent, or Firm*—Seidel, Gonda & Goldhammer

[57] ABSTRACT

Organic materials are separated and retrieved by mixing them with a liquid medium which is solid at room temperature and which is at atmosphere pressure. The material and medium are pumped by an electromagnetic pump while creating turbulence and then the velocity of the medium is decreased while heat is applied. Gases generated during the application of heat are collected. The medium is then cooled and returned to the pool at atmospheric pressure.

9 Claims, 5 Drawing Figures

THERMO-MECHANICAL APPARATUS AND METHOD

BACKGROUND OF THE INVENTION

There is a need for a system for rapid, low-cost thermo-mechanical processing of organic materials such as trash, rubber tires, waste forest products, shale oil recovery, etc. The present invention is directed to a solution of that problem wherein high heat transfer rates are acheived without the need for complex mechanical feed systems, while feed and withdrawal of products is accomplished at atmospheric pressure.

SUMMARY OF THE INVENTION

In accordance with the present invention organic materials are processed in the following manner. A paramagnetic material solid at room temperature but liquified when heat is applied, is melted to form a pool at atmospheric pressure. Organic material is entered into and mixed with the liquified medium in the pool by means of a flow generated vortex. The liquified medium and material are pumped without any direct contact between the medium and the pump while creating the entry vortex and turbulance to thoroughly mix the material in the medium. Thereafter, the velocity of the medium is decreased while applying heat to the medium. Gases generated by the application of heat are removed and then collected. Ash generated by the application of heat is removed. Thereafter, the medium is cooled and returned to the pool at atmospheric pressure.

Various objects and advantages will appear hereinafter.

For the purpose of illustrating the invention, there is shown in the drawings a form which is presently preferred; it being understood, however, that this invention is not limited to the precise arrangements and instrumentalities shown.

DETAILED DESCRIPTION

Figure 1:
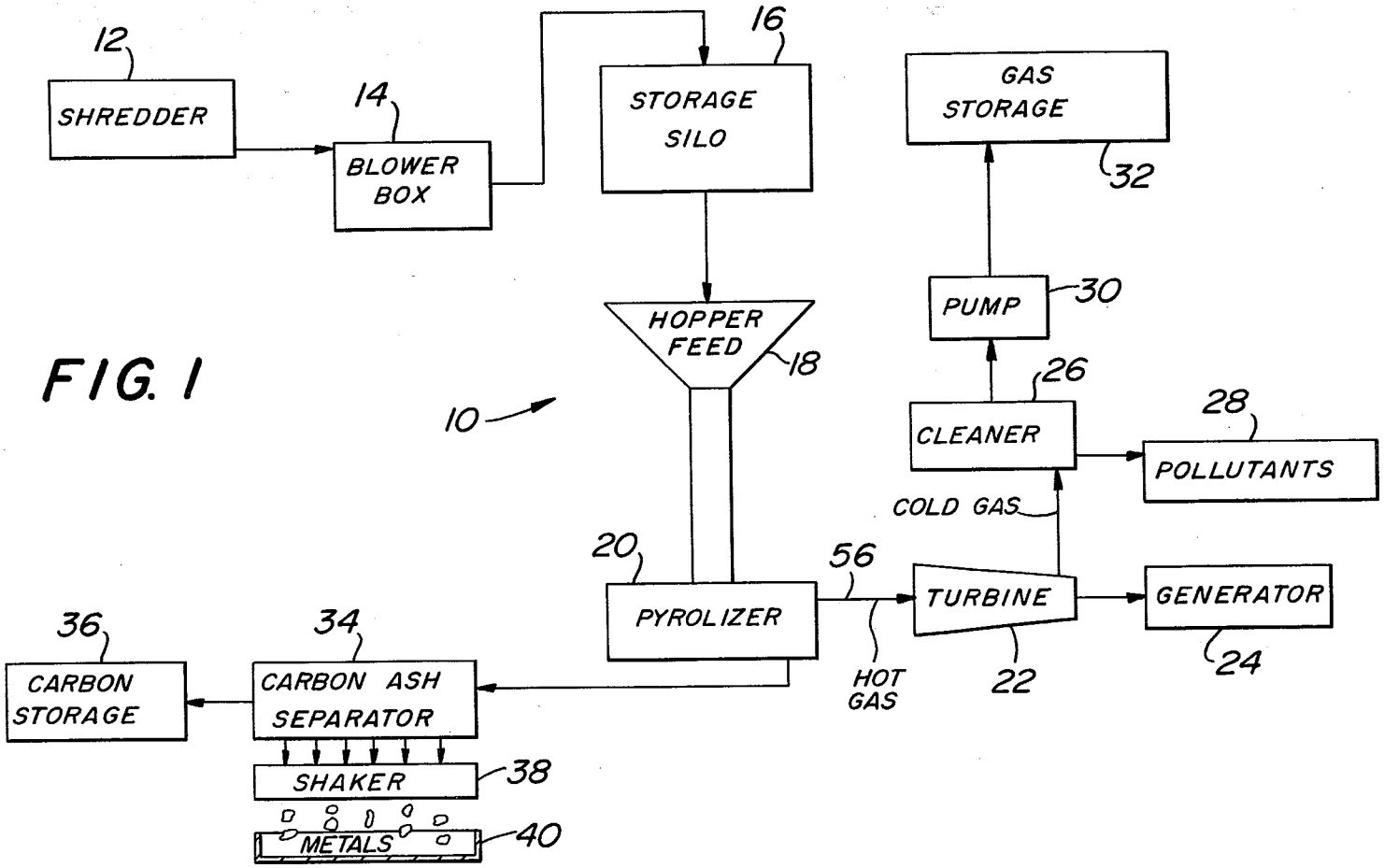
FIG. 1 is a block diagram of apparatus in accordance with the present invention.

Referring to the drawing in detail, wherein like numerals indicate like elements, there is shown in FIG. 1 apparatus in accordance with the present invention. The present invention may be utilized to pyrolize or separate organic matter from inorganic matter such as trash, separate hydrocarbons from tar sand, separate oil from shale, processing coal to generate oil/gas, production of charcoal from coke, etc.

For purposes of disclosure, the thermo-mechanical apparatus of the present invention will be described in connection with providing an environmentally clean solution to trash reduction while recovering energy to offset the expense of the operation of the system designated generally as 10 in FIG. 1. The trash is first shredded in a shredder 12 and removed therefrom by a blower to a blower box 14. From the blower box 14 the shredded trash is conveyed to a storage silo 16. By gravity, the shredded trash is permitted to discharge from the silo 16 to a hopper feed 18. The hopper feed 18 communicates with a pyrolizer 20.

The pyrolizer 20 converts the trash to carbon, ash, and hot gases. The hot gases may be utilized to drive a turbine 22 connected to a generator 24 to provide energy recovery. Thereafter, the cooled gas is directed under pressure to a separater 26 for cleaning the gases by removing airborn pollutants which are collected in a vessel 28. From the separater 26, the gases are pumped by pump 30 to a gas storage vessel 32. In vessel 32, the gases may be separated and stored for subsequent use or sale.

The solid residue of the trash such as ash and carbon are removed from the pyrolizer 20 and delivered to a separater 34. Separater 34 separates carbon and directs it to a carbon storage vessel 36. The ash is directed to a shaker 38 and collected in a vessel 40. The carbon may be reused in any process requiring raw carbon. The ash and other non-organic residue including metals collected in vessel 40 represent approximately 10% of the original volume of material introduced into the system 10.

Figure 2:
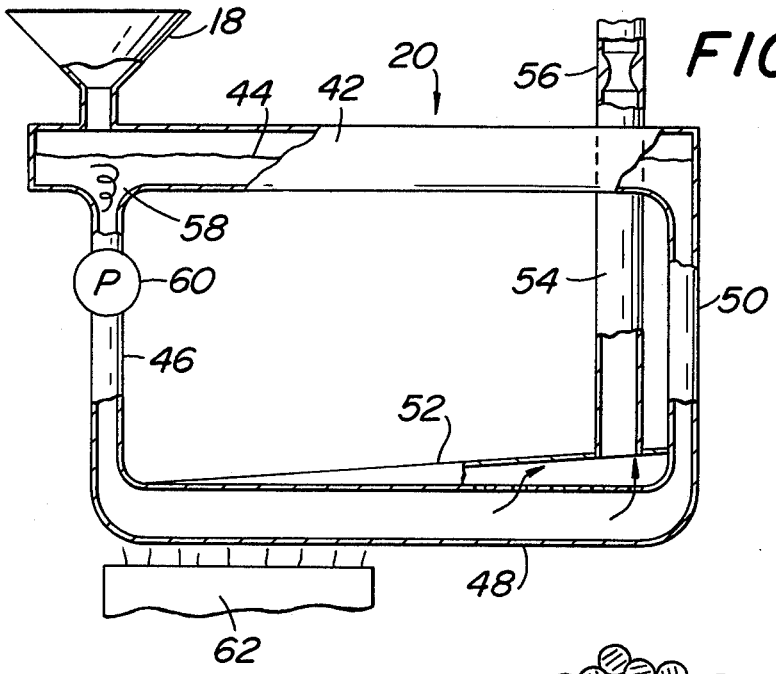
FIG. 2 is a elevation view, partly in section, of a portion of the thermo-mechanical apparatus.

Referring to FIG. 2, there is illustrated one embodiment of a pyrolizer 20. A horizontally disposed vessel 42 contains a pool 44 of a paramagnetic liquid medium which is solid at room temperature and which has been liquified. Vessel 42 is at atmospheric pressure. The pyrolizer 20 includes a down leg 46 supported by the housing 42. Down leg 46 communicates directly with one end of a horizontal leg 48 of increased diameter. The other end of leg 48 communicates with the bottom end of an up leg 50. The upper end of leg 50 communicates with the pool 44.

A gas removal hood 52 is provided in association with the horizontal leg 48. Hood 52 at its downstream end communicates with a gas removal conduit 54 having a throttled venturi 56.

A whirlpool 58 is provided at the intersection of housing 42 and the upper end of leg 46. The intersection of leg 48 with legs 46, 50 is curved as illustrated in FIG. 2. Likewise, the intersection of leg 50 with vessel 42 is curved as illustrated. A pump 60 is provided for causing circulation of the liquid medium through the closed loop. Pump 60 is preferably an electromagnetic pump so that there is no direct contact between any component of the pump and the liquid medium.

The liquid medium may be any one of a variety of materials which are solid at room temperature and which may be magnetically pumped such as lead, lead alloys, woods metal, roses metal, liquified salts to which paramagnetic particles such as ferric oxide have been added, etc.

When the liquid medium is lead, the maximum operating temperature at the free surface should be less than 1500° F. so as to avoid generating toxic lead oxide gases. The preferred liquid medium is lead since it has a heat transfer rate capability which is 10,000 times greater than that of air and 1,000 times greater than that of steam at 800° F.

Figure 3:
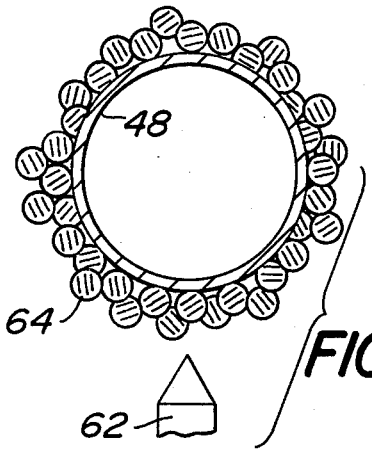
FIG. 3 is a sectional view of the low velocity portion of the thermo-mechanical apparatus.
Figure 4:
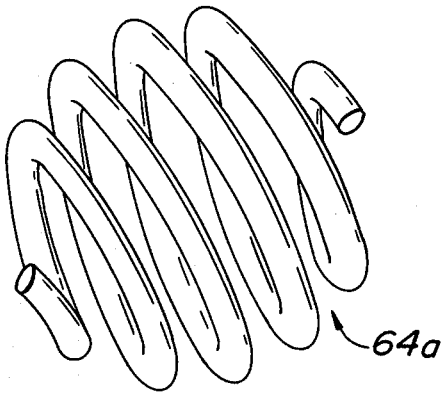
FIG. 4 is a perspecitve view of one form of heat transfer element.
Figure 5:
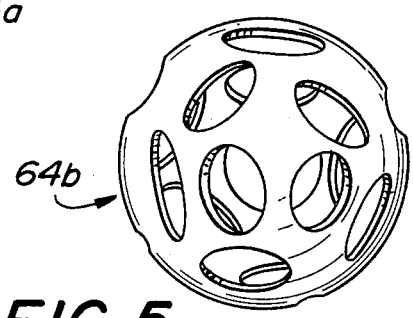
FIG. 5 is a perspective view of another form of heat transfer element.

Due to the increased transverse dimensions of leg 48, as compared with those of leg 46, the velocity of the medium is reduced substantially along leg 48. While the medium is at that reduced velocity, heat is applied from a conventional heater 62. To improve the heat transfer rate, conduit 48 is preferably provided with a plurality of heat transfer elements 64. See FIG. 3. The heat transfer elements 64 are preferably metal spherical elements such as the coil wire element 64 (a) as shown in FIG. 4 or the spherical perforated metal ball 64 (b) as shown in FIG. 5. The heat transfer elements are bonded to each other and the periphery of conduit 48 to form a coating or layer which is 0.5 to 1.5 inches (1.2 to 3.7 cm) thick when conduit 48 has a diameter of 12 inches (30 cm).

The trash containing organic materials introduced into housing 42 from hopper 18 is immediately entrained at the whirlpool 58 to initially create turbulance and an intimate mixing of the trash and the liquified medium. At this point, the mixture of trash and liquified medium is pumped by pump 60 through down leg 46 with a pressure of about 5–10 p.s.i. and a velocity of about 10 feet per second. Heat from the source 62 is applied to the mixture at the inlet end portion of leg 48 while at the same time the velocity is reduced to about 1 foot per second and pressure is increased to about 400–600 p.s.i. by the vertical height of the liquid. Gases generated along leg 48 communicate with the hood 52 and are withdrawn via conduit 54. The throttled venturi 56 prevents the liquified medium from entering into the hood 52.

At the right hand end of leg 48 in FIG. 2, the liquified medium increases in velocity and centrifugally separates any entrained ash and other contaminents. As the liquified medium moves up leg 50, it is cooled as it is returned to the shallow pool 44. The hopper 18 need not be located directly over the whirlpool 58 but can spread the particles evenly over the entire surface of the shallow pool 44. Large differences in the temperature and pressure between the top and bottom of the pyrolizer 20 are easily maintained since the interior of housing 42 and pool 44 are at atmospheric pressure whereby lock hoppers are not needed for feeding material to the pyrolizer 20.

The work done by the magnetic pump 60 once the system is operative is only the work of friction. Initiating movement can be attained by introducing a large gas bubble into the lower end of leg 50. Heat transfer is very fast and efficient in an environment which may be controlled so as to be neutral, oxidizing, or reducing.

The electromagnetic pump 60 eliminates the need for seals, bearing lubrication, contact with the liquified medium, etc. It is an advantage of the system that no specially designed components are needed and there are no moving parts to the pyrolizer.

Thus, there is described a system involving minimal cost, mimimum size, minimum pretreatment input material while operating at a high process rate with no moving parts.

The present invention may be embodied in other specific forms without departing from the spirit or essential attributes thereof and, accordingly, reference should be made to the appended claims, rather than to the foregoing specification, as indicating the scope of the invention.

I claim:

1. A method of thermal processing of organic materials comprising the steps of:

(a) melting a material solid at room temperature to form a liquified medium having magnetic properties, (b) mixing organic materials with a shallow pool of said liquified medium at atmospheric pressure using a flow induced vortex, (c) electromagnetically pumping the mixture of material and medium without any direct contact between the medium and the pump while creating turbulance in the medium, (d) then decreasing velocity of said medium while applying heat to the medium, removing and collecting gases generated by the application of heat to the medium, removing residue from the medium, and (e) cooling said medium while returning said medium to said pool.

2. A method in accordance with claim 1 wherein said liquified medium is a molten metal.

3. A method in accordance with claim 1 wherein said medium is a salt with paramagnetic particles

4. A method in accordance with claim 2 wherein said metal is lead or lead alloy.

5. A method in accordance with claim 1 including providing a whirlpool discharge from said pool for the mixture of organic material and liquified medium as the flow induced vortex.

6. A method in accordance with claim 1 including recovering energy from the collected gases.

7. Apparatus for thermal processing organic materials comprising:

(a) means defining a shallow pool of a medium which is solid at room temperature and which can be electromagnetically pumped, means defining a loop through which said medium is pumped, said loop communicating at its ends with said pool, said pool being at atmospheric pressure, (b) means for electromagnetically pumping said medium through said loop, (c) a portion of said loop being arranged to decrease the velocity of said medium, (d) means for heating the medium as in passes through said loop portion, (e) means for removing gases generated in said loop portion, means for receiving residue removed from said medium, and (f) means for feeding organic materials to said pool.

8. Apparatus in accordance with claim 7 including means defining a flow induced vortex at the outlet from said pool and upstream from said pump.

9. Apparatus in accordance with claim 7 including generally spherical heat transfer elements attached to said loop portion.

* * * * *